US006358020B1

(12) United States Patent
Staton et al.

(10) Patent No.: US 6,358,020 B1
(45) Date of Patent: Mar. 19, 2002

(54) CARTRIDGE-STYLE POWER STEERING PUMP

(75) Inventors: Timothy Matthew Staton, Ypsilanti; Bernard Dale Baughn, Livonia, both of MI (US)

(73) Assignee: Visteon Technologies, Inc., Dearborn, MI (US)

( * ) Notice: Subject to any disclaimer, the term of this patent is extended or adjusted under 35 U.S.C. 154(b) by 0 days.

(21) Appl. No.: 09/372,081

(22) Filed: Aug. 11, 1999

(51) Int. Cl.[7] ..... F04B 17/00; F04B 35/04; F04B 19/24; B23P 15/00; F16B 21/18

(52) U.S. Cl. ..... 417/410.3; 417/53; 29/888.025; 411/525

(58) Field of Search ..... 417/410.3, 53; 415/182.1, 196; 29/888.025; 411/526, 525, 537; 403/408

(56) References Cited

U.S. PATENT DOCUMENTS

| | | | | | |
|---|---|---|---|---|---|
| 3,282,222 | A | * | 11/1966 | Raufeisen et al. | 103/118 |
| 3,468,260 | A | * | 9/1969 | Belden | 103/139 |
| 3,584,708 | A | * | 6/1971 | Heck | 188/71.6 |
| 3,679,329 | A | * | 7/1972 | Drutchas et al. | 417/300 |
| 3,738,784 | A | * | 6/1973 | Clark et al. | 418/270 |
| 4,047,846 | A | * | 9/1977 | Komamura et al. | 417/300 |
| 4,207,038 | A | * | 6/1980 | Strikis | 418/75 |
| 4,408,964 | A | * | 10/1983 | Mochizuki | 417/310 |
| 4,496,288 | A | | 1/1985 | Nakamura | 417/213 |
| 4,616,728 | A | | 10/1986 | Suzuki | 180/142 |
| 4,627,801 | A | * | 12/1986 | Wiisthof et al. | 418/61 B |
| 4,797,071 | A | | 1/1989 | Veyrat | 417/410 |
| 4,978,282 | A | | 12/1990 | Fu | 417/360 |
| 5,044,883 | A | | 9/1991 | Neueder | 415/214.1 |
| 5,171,131 | A | * | 12/1992 | Niemiec | 417/283 |
| 5,195,860 | A | * | 3/1993 | Steyn | 411/526 |
| 5,236,315 | A | | 8/1993 | Hamao | 417/295 |
| 5,267,840 | A | | 12/1993 | Snow | 417/310 |
| 5,344,292 | A | | 9/1994 | Rabenau | 417/413 R |
| 5,393,207 | A | | 2/1995 | Maher | 417/423.7 |
| 5,734,212 | A | * | 3/1998 | Uffelman | 310/51 |
| 5,791,888 | A | | 8/1998 | Smith | 418/149 |
| 5,803,692 | A | * | 9/1998 | Postaden | 411/526 |

* cited by examiner

*Primary Examiner*—Timothy S. Thorpe
*Assistant Examiner*—Timothy P. Solak
(74) *Attorney, Agent, or Firm*—John E. Kajander

(57) ABSTRACT

A cartridge-style pump [10] for a vehicle power steering system can be assembled, tested and shipped independently of an associated pump housing [37]. The pump [10] includes an upper plate [12], a cam plate [16] having a bore [20] formed therein for receipt of a rotor [18], and a lower plate [14]. A plurality of alignment pins [22] are pressed into the lower plate [14] with the cam plate [16] and the upper plate [12] placed onto the alignment pins [22] to locate the plates in their proper position. A plurality of retaining clips [32] are placed onto a respective alignment pin [22] to hold the pump [10] together.

17 Claims, 2 Drawing Sheets

CARTRIDGE-STYLE POWER STEERING PUMP

TECHNICAL FIELD

The present invention relates generally to hydraulic pumps. More particularly, the present invention relates to a cartridge-style vane pump that can be assembled and tested separate and apart from its housing.

BACKGROUND ART

The use of hydraulic pumps, such as power steering pumps, is well known in the automotive industry. Conventional hydraulic pumps, such as those used in power steering systems, are positive displacement pumps.

These positive displacement pumps are typically driven by a drive shaft which is driven by the vehicle engine through an accessory drive system or by the shaft of an electric motor in electrically powered systems. These motor or engine shafts are known to fluctuations that are transmitted to the hydraulic pump by direct coupling of the drive shaft to the hydraulic pump. Motor drive shafts are known to have fluctuations that are transmitted to the hydraulic pump or gear pump by direct coupling of the drive shaft to the hydraulic pump. Current motor drive shafts extend into the pump housing, creating pressure pulsations that can cause the motor to become misaligned with respect to the drive shaft and the pump reservoir.

To eliminate these misalignment problems, current pump designs, including the pump associated pump reservoir and shaft, are typically fully assembled and then transported as a single unit. A typical pump design is assembled by first placing the lower plate of the pump and the pump rotor assembly over the motor drive shaft. Thereafter, a retaining ring is used to lock the rotor onto the drive shaft. Alignment pins are then placed into the lower plate for alignment of the lower plate with respect to the drive shaft over which it was previously placed. The upper plate and the pump cover are then fit onto the alignment pins to align the upper plate and pump cover with respect to the lower plate. An o-ring seal is then placed both on the outside and on the inside of the lower plate and on the pump cover. The assembly is then placed into a pump housing for which it was designed. This completely assembled unitary pump unit is relatively large and expensive. Moreover, because the pump is secured to the pump cover any misalignment of any portion of the pump can cause fluctuations in flow or pressure.

It would therefore be desirable to provide a pump for use in a power steering system that is smaller and less expensive. Further, it would be desirable to have a cartridge-type pump that can be utilized in a variety of different pump reservoirs or housings.

SUMMARY OF THE INVENTION

It is therefore an object of the present invention to provide a cartridge-style vane pump for use in a vehicle power steering system. It is a further object of the present invention to provide a cartridge-style pump that is less expensive to manufacture and assemble than prior pumps and is more precise.

In accordance with the objects of the present invention, a cartridge-style vane pump for use in a power steering system is provided. The pump includes an upper plate, a lower plate, and a cam plate disposed between the upper plate and the lower plate. The cam plate has a rotor disposed in a bore formed therein. The rotor is preferably a vaned rotor that pumps fluid from a fluid reservoir to a power steering gear. A plurality of alignment pins are press fit into the lower plate of the pump and pass through passages in the cam plate and the upper plate to align the plates and hold them together. A plurality of retaining clips are secured on a respective one of the plurality of alignment pins in order to firmly secure the plates together to form the cartridge-style vane pump. This configuration allows the cartridge-style vane pump to be built and tested separate from an associated pump housing into which the pump is intended to be fit.

Other objects and features of the present invention will become apparent when viewed in light of the detailed description of the preferred embodiment when taken in conjunction with the attached drawings and appended claims.

DESCRIPTION OF THE PREFERRED EMBODIMENT

Figure 1:
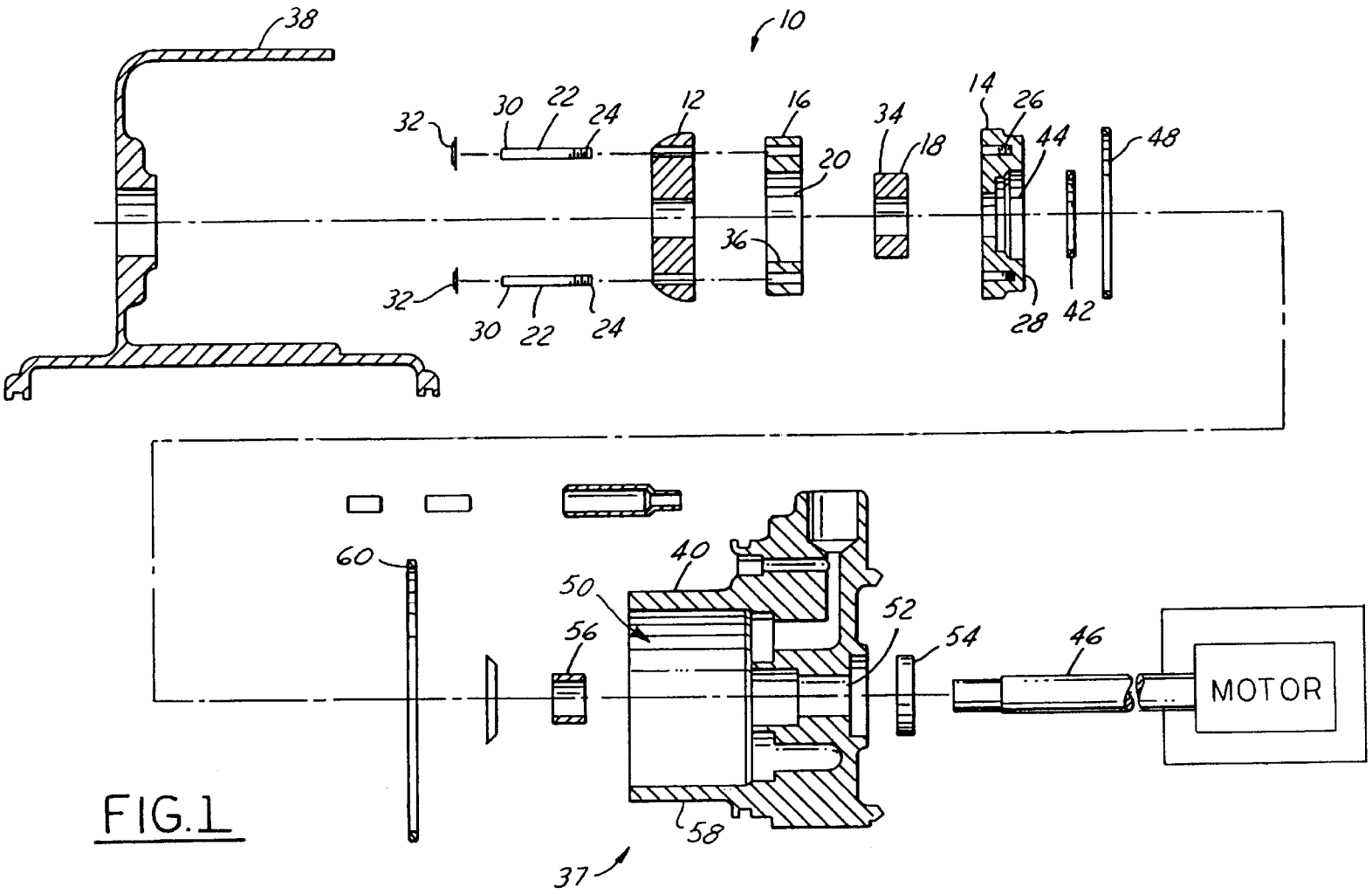
FIG. 1 is a cross-sectional exploded view of a cartridge-style pump and associated pump reservoir in accordance with a preferred embodiment of the present invention.
Figure 2:
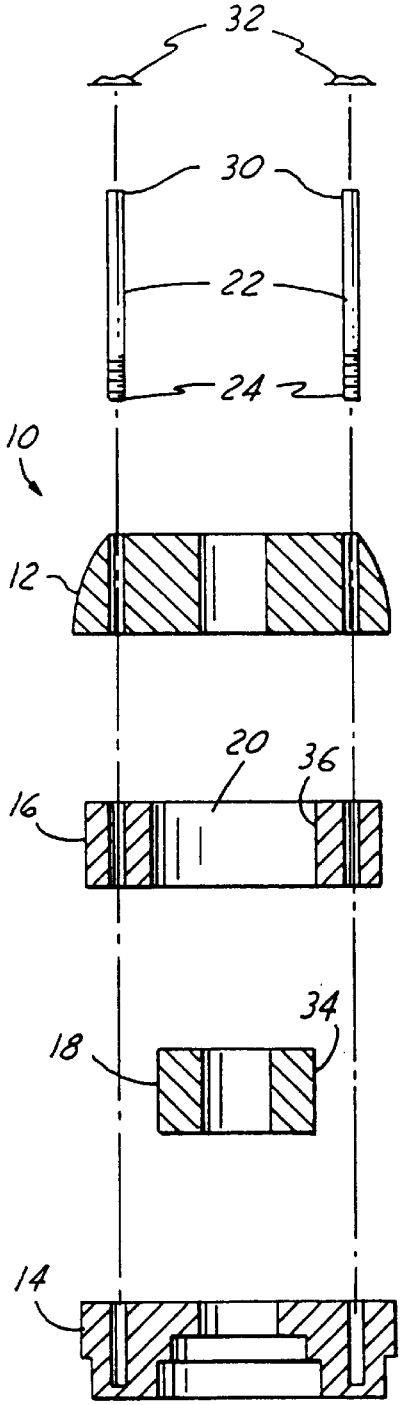
FIG. 2 is a cross-sectional exploded view of the cartridge-style pump of FIG. 1.
Figure 3:
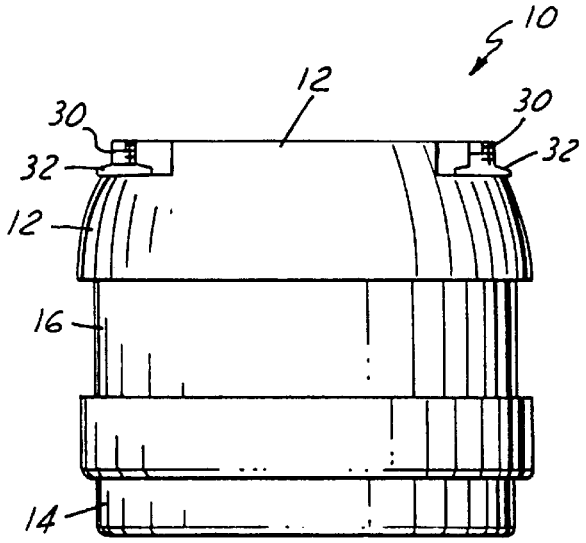
FIG. 3 is a front plan view of a cartridge-style pump in accordance with a preferred embodiment of the present invention.

FIGS. 1 through 3, illustrate a preferred hydraulic pump 10 in accordance with the present invention. The pump 10 is preferably a cartridge-style vane pump that has an upper plate 12, a lower plate 14, and a cam plate 16 disposed therebetween. A rotor 18 is disposed within a bore 20 formed within the cam plate 16. As shown, the pump 10 is preferably comprised of three separate plates. However, it should be understood that the pump 10 could be comprised of a single integral plate, a pair of plates or a variety of other configurations.

A pair of alignment pins 22 are preferably pressed into the lower plate 14 to secure the lower plate 14 to the pins 22. The cam plate 16 and the upper plate 12 are then placed over the alignment pins 22 in order to align the various portions of the pump 10 axially and radially. Each of the alignment pins 22 is preferably press fit into a respective one of a plurality of recesses 26 which are formed in the lower plate 14. The alignment pins 22 thus do not extend below the bottom surface 28 of the lower plate 12. The alignment pins 22 each have an upper end 30 that extends through the upper plate 12 of the pump 10. A pair of retaining clips 32 are secured to the upper ends 30 of the alignment pins 22 adjacent the upper plate 12 in order to hold the pump 10 together once the upper plate 12, the lower plate 14, and the cam rotor 16 are properly aligned.

The rotor 18 is preferably a cylindrical vane rotor having a plurality of slots formed radially around its circumference. A vane is located in a respective one of each of the plurality of slots. The vanes move radially in and out with respect to the outer periphery 34 of the rotor 18. The vanes preferably maintain constant contact with the inner periphery 36 of the bore 20 to help convey fluid from a fluid source to a load. The bore 20 is preferably elliptical in shape in order to effectuate the pumping action. As will be understood by one of skill in the art, the configuration of the rotor 18 and the bore 20 are not limited to the illustrated configuration and a variety of other types of rotors may be utilized and still achieve the objects of the present invention.

Once the pump 10 is placed into its fully assembled position, as shown in FIG. 1, it is then preferably positioned into a pump housing 37. As shown in FIG. 1, the pump housing 37 includes a first reservoir cover portion 38 and a pump reservoir portion 40 that encapsulate and house the cartridge-style pump 10. After the pump 10 has been assembled, an inner o-ring 42 is positioned in the bottom surface 28 of the lower plate 14 in a passageway 44 formed therein. The passageway 44 is intended to receive a pump shaft 46 therethrough to drive the rotor 18. The inner o-ring 42 imparts pressure on the inside of the pump 10 to seal both sides of the lower plate 14. An outer o-ring 48 is positioned around the outer periphery of the lower plate 14 to place pressure on the pump 10 and help seal the lower plate.

The pump 10 is disposed in a fluid reservoir 50 formed in the pump reservoir portion 40 so that the pump shaft 46 passes into the pump reservoir portion 40 through a shaft passage 52. A shaft seal 54 is positioned at the opening of the shaft passage 52 to minimize fluid leakage from the fluid reservoir 50. The shaft 46 communicates with a head bearing 56 to assist in its rotation. The first reservoir cover portion 38 is then disposed over the outer periphery 58 of the pump reservoir portion 40 to enclose the pump in the fluid reservoir 50. A second reservoir cover portion 60 is positioned around the outer periphery 58 of the pump reservoir portion 40 to form the pump housing 37. The second reservoir cover portion 60 preferably secures the first reservoir cover portion 38 to the pump reservoir portion 40.

The pump 10 of the present invention is preferably a hydraulic pump with the pump housing 37 integrally formed with an electric motor in a single housing. The electric motor is coupled to the pump shaft causing the pump shaft to rotate as is well known. The electric motor and the hydraulic pump are located in a single integrated housing, referred to as an integral pump housing electric motor module. The pump/motor combination is preferably incorporated into an electro-hydraulic power steering system for an automobile where power steering fluid is pumped from a fluid source to a steering year. It should be understood that the pump 10 can be utilized in a variety of different applications and for a variety of different uses.

The configuration of the cartridge-style pump 10 allows the pump 10 to be built and tested separate and apart from its associated housing 37. Further, the motor with integral pump housing 37 can be built and tested separately from the pump to keep the oil environment away from the motor. This allows the pump 10 to be incorporated into a variety of different pump housings providing for flexibility, which has not previously been available. Because the pump 10 is a separate unit in of itself, it can be shipped without any associated housing. This significantly reduces the shipping size and weight which in turn results in lower shipping costs.

While particular embodiments of the invention have been shown and described, numerous variations and alternate embodiments will occur to those skilled in the art. Accordingly, it is intended that the invention be limited only in terms of the appended claims.

What is claimed is:

1. A cartridge-type pump for a power steering system and intended to be received within a pump housing, comprising:

an upper plate having a generally planar inner surface;

a lower plate having a generally planar inner surface;

a cam plate disposed between said upper plate and said lower plate, said cam plate having a first surface in direct contact with said inner surface of said upper plate and a second surface in direct contact with said inner surface of said lower plate;

a bore formed in said cam plate and a rotor disposed in said bore;

a plurality of alignment pins pressed into and not passing all the way through a respective one of a plurality of holes formed in said inner surface of said lower plate and passing trough passages in said cam plate and said upper plate to align said plates; and a plurality of retaining clips secured to a respective one of said plurality of alignment pins to hold said plates together and form the pump;

wherein the catridge-type pump can be built and tested separate from the pump housing into which it is intended to be positioned, the pump not having any separate structure attached thereto intended to secure the pump to said pump housing;

the said lower plate having a recess formed therein for receipt of a seal to input pressure on and help seal the pump.

2. A cartridge-type pump as recited in claim 1, wherein said plurality of alignment pins are press fit into one of a plurality of respective recesses formed in said lower plate.

3. A cartridge-type pump as recited in claim 2, wherein each of said plurality of retaining clips engage an upper end of a respective one of said plurality of alignment pins adjacent said upper plate.

4. A hydraulic pump-electric motor module for use in a vehicle power steering system said hydraulic pump, comprising:

a pump housing having a fluid reservoir formed therein;

a cartridge-style pump positioned in said pump housing, said cartridge-style pump including:

an upper portion;

a lower portion;

a middle portion having a bore formed therein for receipt of a rotor;

a plurality of alignment pins passing through each of said upper portion, said middle portion, and said lower portion such tat said upper portion is in direct contact with said middle portion and said middle portion is in direct contact with said lower portion to keep said cartridge-style pump aligned;

a plurality of retaining clips for securing to a respective one of each of said alignment pins to keep said portions together; and a seal positioned around an outer periphery of said pump to apply force to said pump and seal pump with respect to an inner periphery of said pump housing;

whereby said cartridge-style pump can be assembled and tested independent of said power pack.

5. The hydraulic pump-electric motor power pack as recited in claim 4, wherein said upper portion, said lower portion, and said middle portion each comprises a separate plate.

6. The hydraulic pump-electric motor power pack as recited in claim 5, wherein said lower plate has a plurality of recesses formed therein into which a respective one of said alignment pins is press fit.

7. The hydraulic pump-electric motor power pack as recited in claim 6, wherein each of said plurality of alignment pins has an upper portion that extends through said upper portion of said cartridge-style pump, whereby said retaining clips are secured to a respective one of said upper portion of said plurality of alignment pins.

8. The hydraulic pump-electric motor power pack as recited in claim 5, wherein a drive shaft is in communication with said pump to convey fluid from a fluid inlet to a fluid outlet.

9. The hydraulic pump-electric motor power pack as recited in claim 4, wherein said lower portion and said middle portion are a single integral piece.

10. The hydraulic pump-electric motor power pack as recited in claim 4, wherein said rotor is a vane rotor having vanes that engage said bore as said rotor rotates.

11. A method for assembling a cartridge-type pump that can be built and tested separate from an associated pump housing, the pump having no separate structure for retaining the pump in the pump housing, comprising:

providing a lower plate with a generally planar inner surface said lower plate having a recess formed therein for receipt of a seal to impart pressure on and help seal the pump;

forming a plurality of recesses in said inner surface of said lower plate;

press fitting an alignment pin into a respective one of each of said plurality of recesses;

placing a cam plate over said alignment pins and into direct contact with said inner surface of said lower plate to align said cam plate with respect to said lower plate;

placing an upper plate having an inner surface over said alignment pins and into direct contact with said inner surface of said upper plate, such that an upper portion of said alignment pins extend above an upper surface of said upper plate; and securing a retaining clip to said upper end of each of said alignment pins to hold said plates together in alignment.

12. The method as recited in claim 11, further comprising:

inserting an o-ring into a fluid passageway formed in a bottom surface of said lower plate to apply pressure to said plates.

13. The method as recited in claim 11 further comprising:

inserting an o-ring around an outer periphery of said lower plate to apply pressure to said plates and help seal said lower plate.

14. The method as recited in claim 11, further comprising:

locating said pump in the associated pump housing.

15. The method as recited in claim 14, further comprising:

locating said pump in a pump reservoir formed in the associated pump housing.

16. The method as recited in claim 14, further comprising:

inserting a drive shaft into communication with said lower plate of said pump to import motion to said rotor.

17. A method for assembling a cartridge-type pump, comprising:

press-fitting a plurality of pins into an inner surface of a lower plate;

placing a cam plate over each of said plurality of pins such that no structure exists between a first face of said cam plate and said inner surface of said lower plate;

positioning a rotor in a bore formed in said cam plate;

placing an upper plate over said pins such than an inner surface of said upper plate contacts a second surface of said cam plate;

securing a retaining clip to an upper end of said plurality of pins to keep said plate together in alignment; and disposing a seal in a recess formed in a bottom surface of said lower portion to assist in applying a force on the pump.

* * * * *